United States Patent [19]

Hanko et al.

[11] 4,331,238

[45] May 25, 1982

[54] FAST FOOD CONTAINING AND SERVING DEVICE

[75] Inventors: Jimmy J. Hanko; Richard F. Gulliver, both of Tuscaloosa, Ala.

[73] Assignee: Gulf States Paper Corporation, Tuscaloosa, Ala.

[21] Appl. No.: 180,809

[22] Filed: Aug. 25, 1980

[51] Int. Cl.[3] ..... B65D 5/35; B65D 43/16

[52] U.S. Cl. ..... 206/518; 229/33; 229/36; 229/45 R

[58] Field of Search ..... 206/525, 216, 518; 229/45, 33, 35, 36, 52 B, 31 FS

[56] References Cited

U.S. PATENT DOCUMENTS

| | | | |
|---|---|---|---|
| 2,336,494 | 12/1943 | Metcalf | 229/31 |
| 2,545,802 | 3/1951 | Bergstein | 229/45 |
| 2,741,418 | 4/1956 | Van Rosen | 229/45 |
| 3,019,958 | 2/1962 | Asman et al. | 229/31 |
| 3,968,922 | 7/1976 | Ruud | 229/33 |
| 4,081,125 | 3/1978 | Meyers | 229/31 |

*Primary Examiner*—William T. Dixson, Jr.
*Attorney, Agent, or Firm*—Cushman, Darby & Cushman

[57] ABSTRACT

A fast food containing and serving device comprising a thin wall structure erected from a paperboard blank so as to be movable (1) from a tray defining position wherein the same can be stored in a stacked nested relationship with a multiplicity of similar thin wall structures into a closed container defining position wherein fast food or the like can be contained therein and (2) from the closed container defining position back into a tray defining position wherein the same can be used in serving the fast food or the like contained therein. The movement of the thin wall structure between the tray defining position and the closed container defining position is facilitated by a pair of spaced fold lines extending in the central portion of the flat bottom wall thereof between the central portions of the associated pair of side walls thereof and four cooperating fold lines in the central portions of each side wall. The thin wall structure when in the closed container defining position is folded along the pair of spaced fold lines and four cooperating fold lines of each side wall to generally enclose a fast food containing space encompassed (1) at its bottom by an end portion of the bottom wall, (2) at its top by an opposite end portion of the bottom wall and (3) peripherally by the end and side walls and a central portion of the bottom wall. Each set of four cooperating fold lines forms an outwardly folding locking flap operable to be hinged into a contiguous exterior locking position and releasably retained therein to thereby releasably retain the thin wall structure in its closed container defining position.

16 Claims, 8 Drawing Figures

FIG. 7
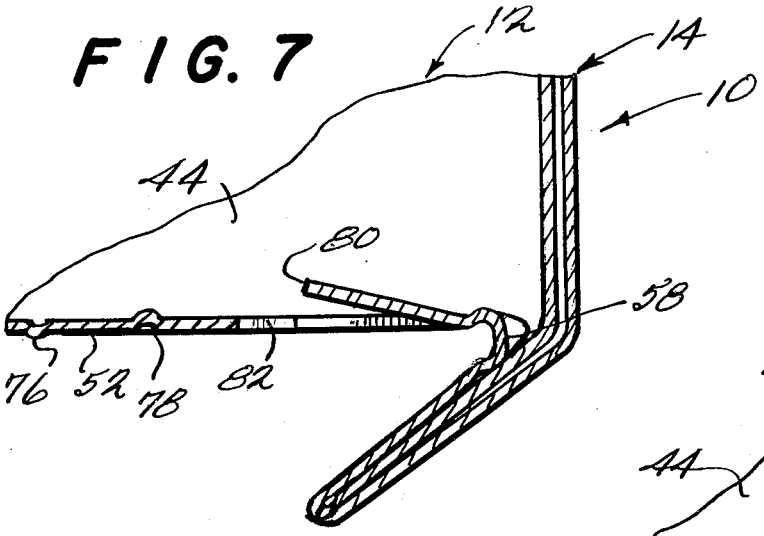
FIG. 6
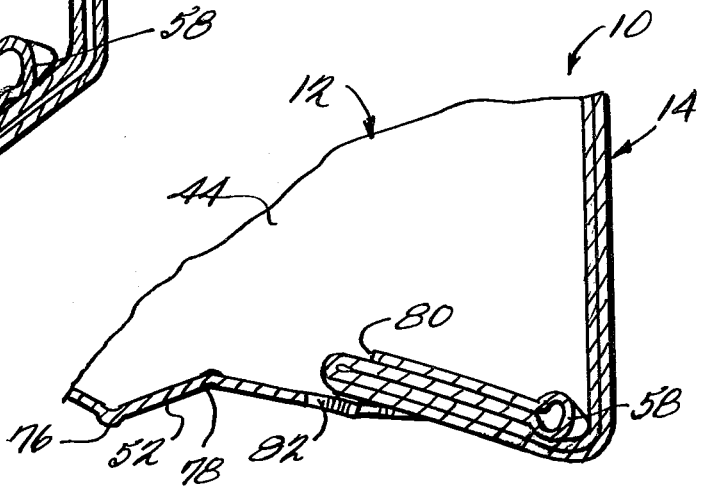
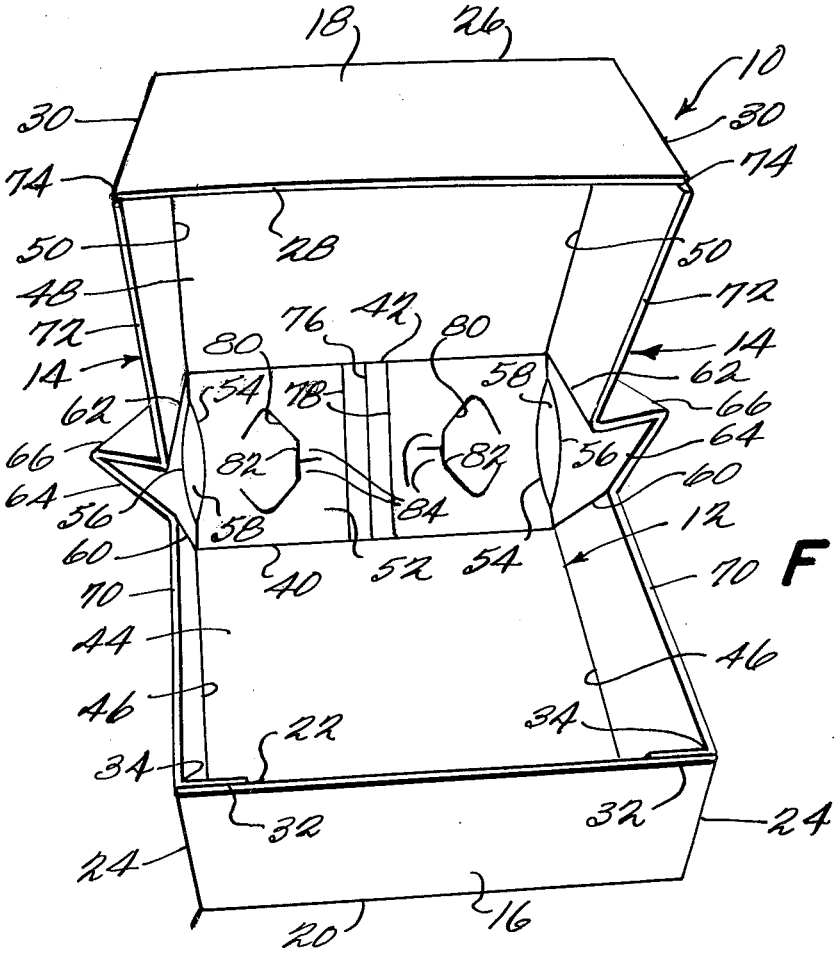
FIG. 8

FAST FOOD CONTAINING AND SERVING DEVICE

This invention relates to containers and more particularly to containers useful in the fast food business as devices for containing and serving fast foods.

It has become the practice in fast food establishments to provide containers of thin wall construction for various fast food items such as hamburgers and the like. In general, it can be stated that it is preferable to handle the containers in an erected condition rather than in a flat blank condition. By storing and handling the containers in an erected condition in the fast food establishment, the time and effort required to erect the carton from a flat blank is eliminated. However, in order to provide for the convenient storage and use of erected cartons it is important that such cartons be nestable and stackable. Another requirement of such fast food type containers, is that they be capable of being easily and conveniently filled with fast food and moved from an open position after filling into a closed position. A container which enjoys widespread use at the present time is a container which, when erected, consists of a hingedly interconnected bottom and top structure, each of which is in the form of a truncated pyramid with a wall enclosing the smaller truncated square. Stated differently, each structure when in its erected condition consists essentially of a square lower wall having four interconnected side and end walls extending upwardly and outwardly therefrom. The two structures are hingedly interconnected at the upper edges of two of the end walls which form the rear end wall of the closed container. One widely used embodiment of a container of this type is molded in its erected condition from foamed plastic. Another container of this dual frusto-pyramidal configuration is erected from a flat paperboard blank. An example of this latter container in the patented literature is contained in U.S. Pat. No. 3,968,922.

While the dual frusto-pyramidal type container has received widespread use, it nevertheless suffers from one major disadvantage, and that is that some difficulty is presented in handling the fast food with respect to the open erected container. Such difficulties are particularly true in the case of hamburgers and other sandwich fast foods which are layered and have layer thicknesses which are considerably less than the depth of the frusto-pyramidal bottom structure of the container. The difficulty results from the necessity of the user to manually grip the lower portions of the sandwich from above in order to move the sandwich into and out of supported relation with the bottom. These difficulties are particularly troublesome to the fast food customer who is attempting to utilize the container in its open condition as a serving device for the fast food. When performing this function the container must come in contact with the sandwich and the user's fingers several times before the fast food is consumed. Because of the space restrictions provided by a four-walled structure designed to reasonably contain the fast food sandwich, the necessity to move the sandwich into and out of supported relation to the bottom wall of the bottom structure frequently results in a messy situation where special sauces, grease and the like habitually contact the user's fingers.

It has been proposed in the expired patented literature to provide a container which will overcome the main disadvantage of the dual pyramidal type container noted above. U.S. Pat. No. 3,019,958 discloses a thin wall container structure which is movable (1) from a tray defining position wherein the same can be stored in a stacked nested relationship with a multiplicity of similar thin wall structures into a closed container defining position wherein fast food or the like can be contained therein, and (2) from the closed container defining position thereof back into a tray defining position wherein the same can be used in serving the fast food or the like contained therein. The thin wall container structure when in its tray defining position includes a flat bottom wall peripherally defined by a pair of side edges and a pair of end edges extending between the side edges, a pair of side walls extending from the side edges of the bottom wall in a direction upwardly and outwardly with respect to one another, a pair of end walls extending from the end edges of the bottom wall in a direction upwardly and outwardly with respect to one another and means for securing the adjacent edges of each pair of adjacent end and side walls in fixedly interconnected relation so that the upwardly and outwardly extending end and side walls define with the flat bottom wall a stable three-dimensional nestable tray. Means is provided for facilitating the movement of the thin wall structure between the tray defining position and the closed container defining position including a pair of spaced fold lines extending in the central portion of the flat bottom wall between the central portions of the associated pair of side walls and cooperating fold line means in the central portion of the pair of side walls.

When the thin wall structure is in its closed container defining position the thin wall structure is folded along the pair of spaced fold lines and cooperating fold line means to generally enclose a fast food containing space encompassed (1) at its bottom by a portion of the bottom wall defining peripherally by one of the pair of fold lines, an adjacent end edge and the portions of the side edges extending therebetween, (2) at its top by a portion of the bottom wall defined by the other of the pair of fold lines, an adjacent end edge and the portions of the side edges extending therebetween, and (3) peripherally by the end and side walls and a central portion of the bottom wall defining peripherally by the pair of fold lines and the portions of the side edges extending therebetween. In this way, the thin wall structure is stored and handled as a stable pre-erected three-dimensional nestable and stackable tray. In its closed container defining position the thin wall structure confines and contains fast food to the same extent as the dual frusto-pyramidal type container of the prior art. However, in its tray defining open position, the problems presented by the four-walled structure of the prior art are eliminated. Instead there is provided an enlarged four-wall container, less than one-half of which is of a size comparable to the size of the fast food to be contained therein. Consequently, the portion of the thin wall structure which receives the fast food when the thin wall structure is in its open tray defining position is closed peripherally only along three sides, with the other side being generally open. Consequently, the fast food establishment personnel filling the container have much more convenient control of the fast food during the loading operation, since the fast food can be handled from the bottom with the hand extending horizontally therefrom. Of additional significance is the added convenience which the open tray position provides for the fast food customer when it performs the serving function during the consumption of the fast food by the consumer.

Despite the recognition of these advantages over the presently utilized dual pyramidal type container, the container disclosed in the aforesaid expired patent remains essentially a proposal rather than an actual container enjoying wide-spread commercial usage. While all of the reasons for such non-usage probably cannot be accurately ascertained, it will be noted that difficulties are introduced by the existence of the inwardly folding portions of the side walls which are simply not presented with the presently utilized dual pyramidal type containers. Thus, whereas the utilized dual pyramidal containers are moved from open position to closed position by a simple pivotal movement along a linear hinge, the comparable movement of the proposed expired prior art container requires pivotal movement about two parallel linear hinges in conjunction with an inwardly folding movement of two side wall portions. In order for the side wall portions to move in properly folded relation, it is necessary for the several interconnected portions to fold in a predetermined sequence. Proper sequencing cannot be always achieved without some manual manipulation, particularly since the side wall portions must swing inwardly in close proximity, if not interfering, relation to the fast food loaded inside the tray. The presence of the fast food also adds to the difficulty in accomplishing manual manipulation when needed. In addition, manual manipulation is made more difficult because of the necessity to effect the closing of the container simultaneously, a requirement which clearly restricts the possibility of manual entry.

In a fast food operation manual manipulations of this difficulty cannot be realistically carried out with the result being one in which closure is often accomplished without the side wall portions being moved through and into their proper folded relation but rather into a forced position tending to bias the cover upwardly. Under these circumstances the locking of the cover into its closed position must be manually accomplished in a highly effective manner or otherwise the cover will become unlocked and move into a partially open position because of the bias imposed by the improperly folded side wall portions. Where the container is in a partially open position difficulties are encountered in handling the same in the fast food operation.

It is an object of the present invention to provide a container of the type disclosed in the aforesaid U.S. Pat. No. 3,019,958 which achieves all of the advantages thereof in comparison with the prior art dual pyramidal type containers while at the same time obviating the apparent disadvantages noted above with respect to the container disclosed in the aforesaid patent. In accordance with the principles of the present invention this objective is obtained by forming the fold lines in the central side wall sections such that they serve to provide outwardly extending flaps during the folding of the thin wall structure from its open tray defining position into its closed container defining position. Preferably, the outwardly extending flaps are then utilized as a cooperating part of the means for locking the thin wall structure into its closed container defining position. With this arrangement the manual manipulation normally required to effect closure and interengagement of the locking elements can be readily accomplished by manually gripping the side wall portions which provide the flaps thus simultaneously insuring proper folding thereof without the necessity of performing multiple manipulations. Moreover, convenient manual access because of the exterior position of the flaps insures simplicity and speed.

Preferably, the outwardly extending flaps are folded rearwardly and engage within locking tabs formed in the rear wall of the closed container, such locking tabs being defined by cuts formed in the rear wall. Preferably, slot opening portions are formed in the hinge connections between the outwardly extending flaps and the rear wall so that when the flaps are hinged into their locked position the slot opening portions serve to open the tab defining slots in response to the hinged movement of the tabs. Preferably the slot opening portions are of biconvex lens configuration. Finally, the central portion of the rear wall is provided with three parallel fold lines which function to retain the flaps in their cooperating locked condition within the locking tabs through an over-center type toggle action. The locking principles embodied in the present invention have applicability to a wide variety of different types of containers besides those which are provided primarily to function as fast food containing and serving devices.

Accordingly it is another object of the present invention to provide a container of the type described which is simple in construction, economical to manufacture and effective in operation.

These and other objects of the present invention will become more apparent during the course of the following detailed description and appended claims.

The invention may best be understood with reference to the accompanying drawings, wherein illustrative embodiments are shown.

In the drawings:

FIG. 6 is an enlarged fragmentary sectional view taken along the line 6—6 of FIG. 5;

FIG.7 is a view similar to FIG. 6 showing the position of the parts during the movement of the flap from the position shown in FIG. 4 to the locked position shown in FIG. 6; and FIG. 8 is a perspective view of the device showing the same without food therein in an intermediate position between its open tray defining position and its closed container defining position.

Figure 2:
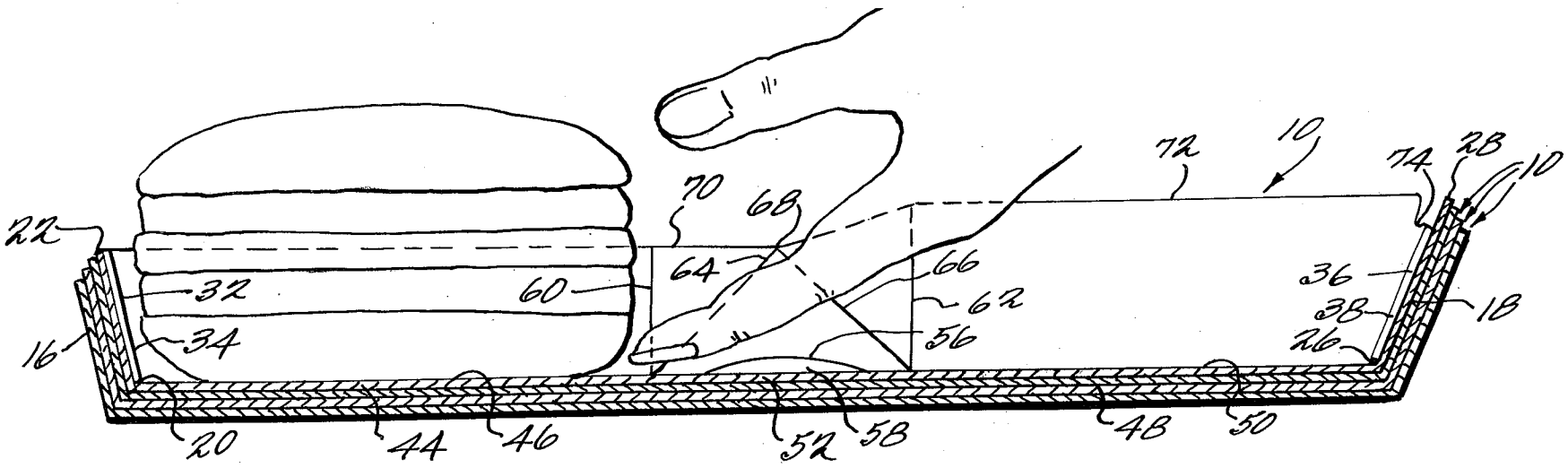
FIG. 2 is a vertical sectional view of the fast food containing and serving device erected from the blank shown in FIG. 1, illustrating the same in a nested and stacked relationship with respect to a plurality of similar devices and the manner in which the device is manually filled with fast food and utilized to serve such fast food.
Figure 3:
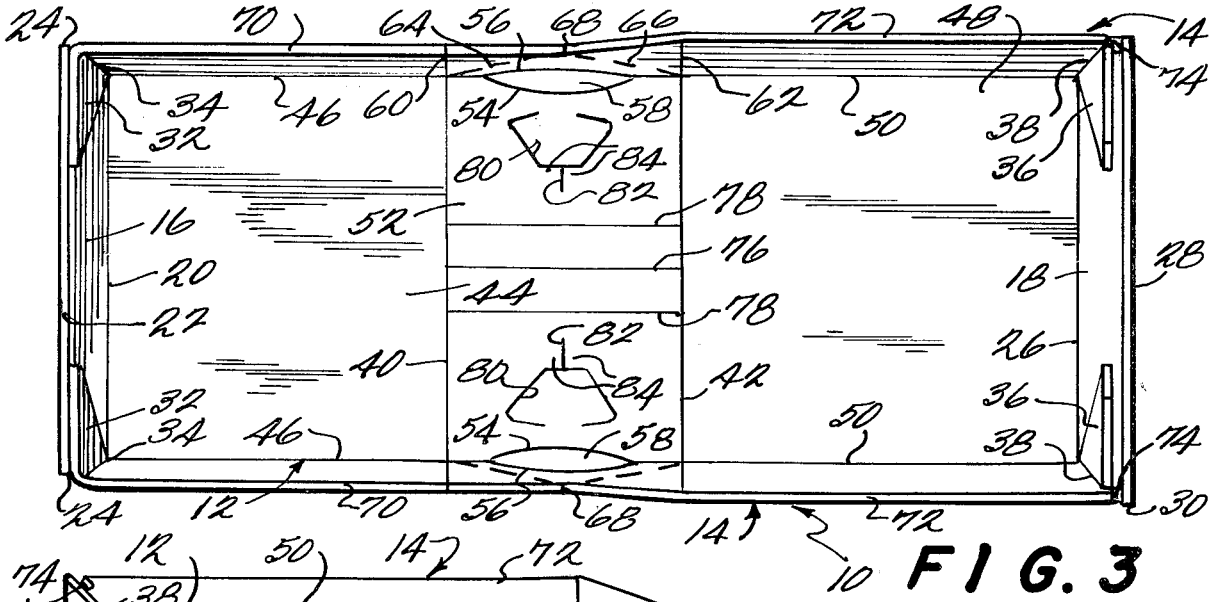
FIG. 3 is a top plan view of the fast food containing and serving device shown in FIG. 2 in its open tray defining position.
Figure 4:
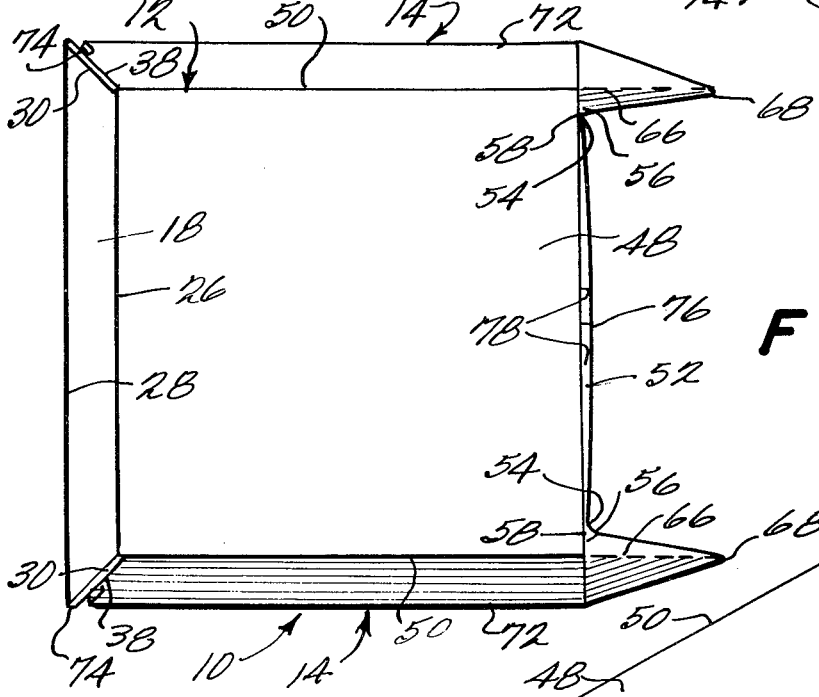
FIG. 4 is a top plan view of the device showing the position of the same after it has been folded into its closed container defining position and before the exterior flaps have been moved into their locked condition.
Figure 5:
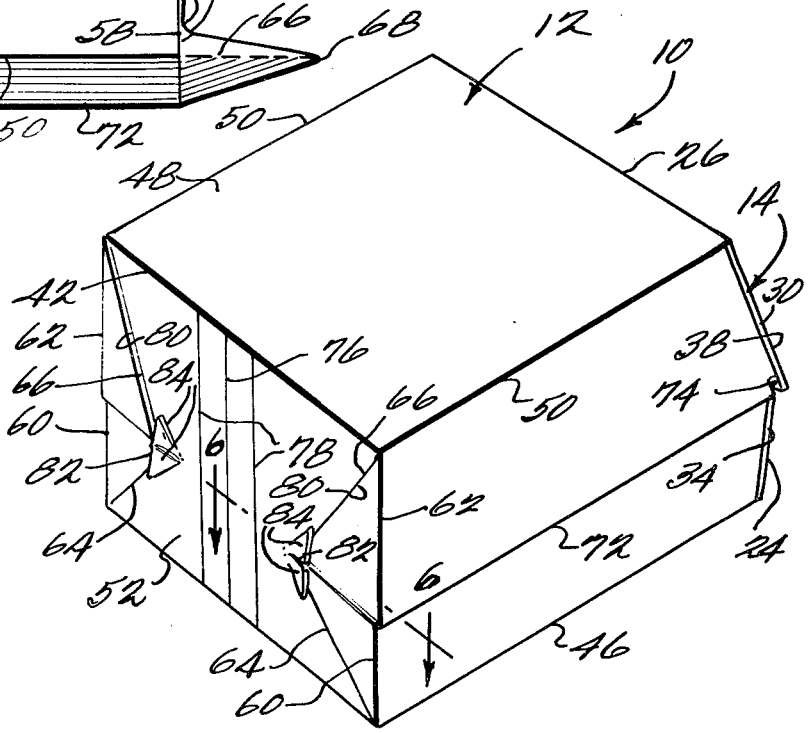
FIG. 5 is a perspective view of the device showing the same in its closed container defining position with the flaps in locked condition.

Referring now more particularly to FIGS. 1–5 of the drawings, there is shown therein a fast food containing and serving device, generally indicated at 10, in the form of a thin wall structure. The thin wall structure when functioning as a fast food containing and serving device 10 is movable (1) from a tray defining position, such as shown in FIGS. 2 and 3 wherein the same can be stored in a stacked nested relationship with a multiplicity of similar thin wall structures, as shown in FIG. 2, into a closed container defining position, as shown in FIG. 5, wherein fast food or the like can be contained therein; and (2) from the closed container defining position back into the tray defining position where the same can be used in serving the fast food or the like contained therein as illustrated in FIG. 2.

Figure 1:
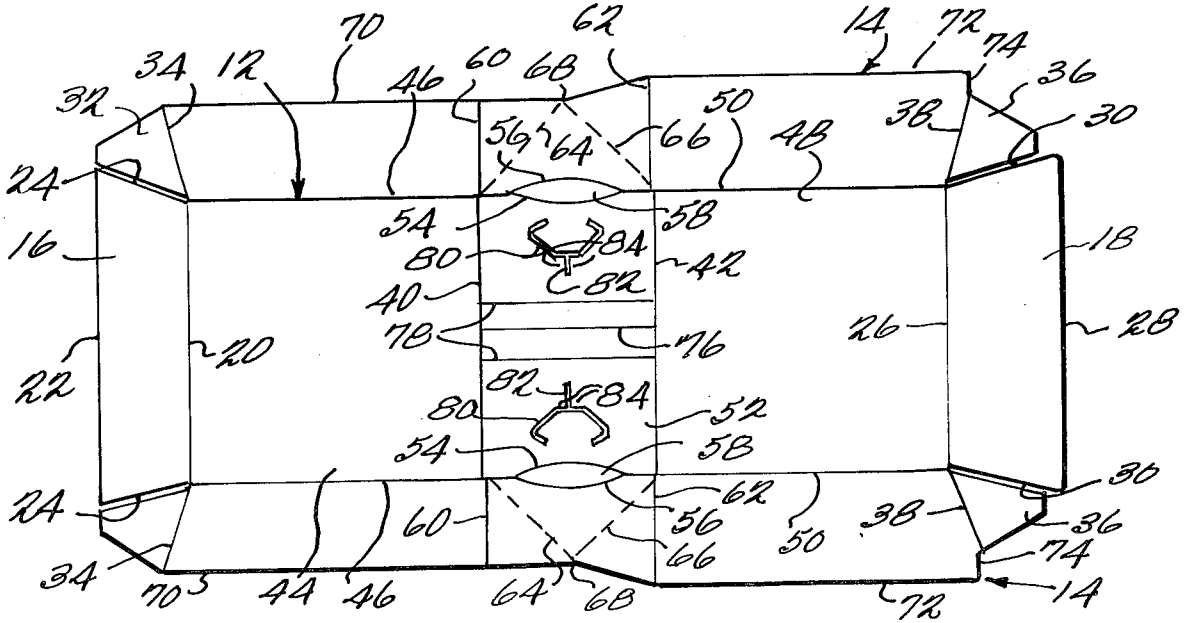
FIG. 1 is a plan view of a cut and scored blank capable of being erected to form one embodiment of a fast food containing and serving device embodying the principles of the present invention.

The thin wall structure may be formed in its tray defining position by molding a thin wall of plastic material, as, for example, foam plastic, into a three-dimensional tray configuration. However, as shown, the thin wall structure in its tray defining position is preferably erected from a blank cut and scored from a sheet of paperboard, as, for example, a sheet of bleached sulfate board. Such a blank is shown in FIG. 1, and includes in general a rectangularly shaped flat bottom wall, generally indicated at 12, having a pair of side walls, generally indicated at 14, hinged to opposite sides thereof and a pair of end walls 16 and 18 hinged to the ends thereof. End wall 16 is hinged to the bottom wall 12 along a fold line 20 which defines one end edge of the bottom wall 12. The cut outline of the blank defines an outer edge 22 of the end wall 16 which extends in a parallel relationship with the fold line 20. The blank has cuts extending between the ends of the fold lines 20 outwardly therefrom in diverging relation so as to define a pair of outwardly inclined end edges 24 of the end wall 16. The end wall 18 is configured similarly to the end wall 16 in that it is defined interiorly by a fold line 26, exteriorly by the outline configuration of the blank along a parallel outer edge 28 and by cut lines defining outwardly inclined end edges 30. It will be noted, however, that end wall 18 differs from end wall 16 in that the end wall 18 is thicker than the end wall 16. Stated differently, the distance between the parallel side edges 20 and 22 of the end wall 16 is less than the distance between the parallel side edges 26 and 28 of the end wall 18.

The cuts which define the end edges 24 also serve to define one edge of a pair of generally triangularly shaped flaps or tabs 32 formed integrally as an end portion of the side walls 14. Each tab also is formed with an interior fold line 34 which extends from the inner end of the associated cut 24 outwardly at an angle therefrom and defines the adjacent end edge of the associated side wall 14. In a similar fashion, the cuts which define the end edges 30 also serve to define one side of a second pair of flaps or tabs 36. As before, each tab 36 is defined interiorly by an outwardly inclined fold line 38 which also defines the adjacent end of the associated side wall 14.

In order to facilitate movement of the thin wall structure between its tray defining position and its closed container defining position, there is provided in the central area of the bottom wall a pair of parallel fold lines 40 and 42 which are parallel with the fold lines 20 and 26 as well. Fold lines 20 and 40 define the ends of a bottom wall portion 44 the sides of which are defined by fold lines 46 defining the associated portion of the hinge connection between the bottom wall 12 and side walls 14. The bottom wall portion 44 preferably serves as a bottom for the fast food containing and serving device 10 when the latter is in its closed container defining position. Fold lines 42 and 26 define the ends of a bottom wall portion 48, the sides of which are defined by fold lines 50 defining the associated portion of the hinge connection between the bottom wall 12 and side walls 14. The bottom wall portion 48 preferably serves as a top for the fast food containing and serving device when the latter is in its closed container position. Fold lines 40 and 42 define therebetween parallel edges of a central bottom wall portion 52. The other pair of edges of the central bottom wall portion 42 are defined by fold lines 54, each of which includes a pair of aligned straight sections connecting with the associated fold lines 46 and 50 and a central inwardly curved section. Each curved central section has formed in cooperating relation therewith an outwardly curved section 56 which defines therewith a cut opening wall portion 58. As shown, each cut opening wall portion 58 has a configuration similar to a biconvex lens.

Folding of the device 10 between its tray defining position and closed container defining position is also facilitated by flap defining fold lines formed in the central portion of each side wall 14. As shown, the flap defining fold lines in each side wall 14 include a pair of parallel fold lines 60 and 62 disposed in general alignment with the fold lines 40 and 42 respectively and a pair of converging angularly related fold lines 64 and 66 extending respectively from the juncture between the fold lines 40 and 60 and the juncture between the fold lines 42 and 62 respectively to a common central point 68 at the outline of the blank. As shown, fold lines 64 and 66 are provided by a series of longitudinally spaced and aligned cuts, as is well known in the art, rather than indentations such as the remaining fold lines. The indentation fold line is likewise well known in the art. It will be noted that the outline of the blank serves to define an outer side edge 70 which extends from the associated tab fold line 30 to the associated point 68. The outline of the blank also defines an outer edge portion 72 of the remainder of each side wall which is disposed outwardly with respect to the side edge 70. As shown, each side edge 70 extends angularly from the point 68 to the adjacent fold line 62 and then in parallel fashion to a transversely extending short outline edge surface 74.

The blank also has provided in the central bottom wall portion 52 thereof suitable score lines and cuts which serve to facilitate the locking of the device into its closed container defining position. As shown, there is provided a central score line 76 which extends between the fold lines 40 and 42 in perpendicular relation thereto. Formed on opposite sides of the central score line 76 is a pair of parallel score lines 78. The cuts include a pair of oppositely facing generally C-shaped cuts 80, each C-shaped cut 80 being formed of straight angularly related cuts rather than curved cuts. Each C-shaped cut includes a short transverse cut 82 extending from the central portion thereof which defines with the associated C-shaped cut a pair of generally triangularly-shaped locking tabs 84.

It will be understood that the box blank is adapted to be erected into a stable three-dimensional nestable tray configuration by the utilization of conventional erecting equipment well known for this purpose. Non-foldable trays of this configuration are well known in the prior art, as disclosed in U.S. Pat. Nos. 2,336,494 and 4,081,125. The fast food containing and serving device 10 is shown in its tray forming position in FIG. 3 and it will be noted that tabs 32 have been folded inwardly along the fold lines 34, tabs 36 have been folded inwardly along the lines 38, side walls 14 have been folded in a position upwardly and outwardly with respect to the bottom wall 12 along fold lines 46, 50, 54 and 56 and end walls 16 and 18 have been folded upwardly and outwardly along fold lines 20 and 26 respectively. In this erected position, the outer surfaces of the tabs 34 and 36 are disposed in surface-to-surface contact with the adjacent inner surface of the end walls 16 and 18 respectively. This surface-to-surface contact is fixedly secured as by suitably gluing the surfaces or by the utilization of staples or the like, a preferred securement being glue.

FIG. 2 illustrates the contemplated fast food use of the device 10. In FIG. 2 the device 10 is shown in its open tray defining position in nested relation with respect to a plurality of similar devices 10. It will be understood that the device 10 is adapted to be stored for immediate use in the fast food establishment in this stacked relation. FIG. 2 illustrates how the fast food establishment personnel fill the open device 10 with fast food as, for example, a double decker hamburger. It is noted that the operator is able to grip the hamburger with the fingers at the bottom of the same and to lower the hamburger into supported relation to the bottom wall portion 44 with the hand extending horizontally therefrom. As is clearly shown in FIG. 2, the operator is able to position his hand in the space which is occupied by a wall in the prior art dual frusto-pyramidal type container.

Either before or after filling, as indicated, the device is separated from the stack and the operator folds the device along the fold lines 40 and 42 so as to move the bottom wall portion 48 from a horizontal position of alignment with the bottom wall portion 44 to a position overlying and parallel thereto. During this movement folding occurs along the fold lines 60, 62, 64 and 66 at the central portion of each side wall 14 so that when the bottom wall portion 48 reaches the overlying position generally rearwardly extending flaps are formed at the flap defining folds. It will also be understood that the lower periphery of the end wall 18 will extend below the upper edge 22 of the end wall 16. The ends of the upper edge 22 engage within the openings provided by the surfaces 74 and seat within the inner edges thereof to limit the extent of downward movement of the top structure with respect to the bottom structure. Similarly the portions of the side walls included within the top structure overlap and extend below the portions of the side walls included within the bottom structure.

After the operator has effected the folding movement in the manner thusfar described, the operator then manually moves each of the rearwardly extending flaps inwardly toward the wall portion 52. FIGS. 6 and 7 illustrate the slot opening action which occurs as a result of this movement by virtue of the provision of the biconvex lens-shaped slot opening portions 58. It will be noted that the position of each portion 58 is such that it is disposed along the hinge line of the flap. Consequently, as the flap is hinged toward the wall portion 52, the slot opening portion 58 assumes a transverse position and deflects the associated section of the wall portion 52 defined within and adjacent the C-shaped slot 80 inwardly, thus opening the slot 80 for the reception of the flap therein. This position is clearly shown in FIG. 7. It will be noted that the triangular locking tabs 84 are thus presented in a position to be deflected by the tip of the flap as it passes thereby so that the locking interengagement is readily accomplished.

It will also be noted that as the tip of the flap moves past the locking tabs the adjacent remaining section of the rear wall portion 52 exteriorly of the C-slot 80 tends to deflect inwardly along the associated score line 78 so that after the flap has been interengaged with the locking tabs and the manual grip of the flap is released, the tendency of the flap to return outwardly applies an outward force to the locking tabs, which movement is restricted by virtue of the inward deflection of the aforesaid section of the wall portion 52 along line 78. As is shown in FIG. 6, the application of the locking force to the locking tabs retains the wall portion 52 in an inwardly deflected position as shown by an essentially over-center toggle action. It will be noted that when the flap is in its locked position, the hinge of the flap extends generally perpendicularly so that the overlapping side wall portions of the device 10 when in a closed position as shown in FIG. 5 assume a relatively straight vertical condition along the wall portion 52 and gradually flare outwardly adjacent the end walls 16 and 18.

The provision of fold lines 60, 62, 64 and 66 in the central portion of the side walls 14 is important for two reasons. First, by providing fold lines rather than full cuts, the side wall integrity is maintained so that the device forms a stable three-dimensional tray in its open tray defining position. Since each device in its tray defining position is stable, a multiplicity of such devices when nested forms a stable stack. Second, by maintaining the integrity of the central portion of each side wall, the movement of the associated flap into its locked position and the retention thereof by the locking tabs in such position serves to hold the top structure and the bottom structure provided by the device when in its closed container defining position in locked interengagement without the necessity of providing interengaging locking means on the end walls 16 and 18.

While the construction described above is greatly preferred, it will be understood that in situations where it is important that the bottom wall be completely devoid of all openings such as the cuts 80 and 82, the tabs may be hinged forwardly instead of rearwardly and locked in such position by locking tabs provided by cuts in the side walls.

It will be understood that the terms such as top, bottom, front, rear, upstanding, depending and the like are used in their relative sense rather than their absolute directional sense in the present specification and claims.

It thus will be seen that the objects of this invention have been fully and effectively accomplished. It will be realized, however, that the foregiong preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In a fast food containing and serving device comprising a thin wall structure movable (1) from a tray defining position wherein the same can be stored in a stacked nested relationship with a multiplicity of similar thin wall structures into a closed container defining position wherein fast food or the like can be contained therein and (2) from said closed container defining position back into a tray defining position wherein the same can be used in serving the fast food or the like contained therein, said thin wall structure when in said tray defining position including a flat bottom wall peripherally defined by a pair of side edges and a pair of end edges extending between said side edges; a pair of side walls extending from the side edges of said bottom wall in a direction upwardly and outwardly with respect to one another; a pair of end walls extending from the end edges of said bottom wall in a direction upwardly and outwardly with respect to one another; means for fixedly interconnecting the adjacent edges of each pair of adjacent end and side walls so that said upwardly and outwardly extending end and side walls define with said flat bottom wall a stable three-dimensional nestable tray; means for facilitating the movement of said thin wall structure between said tray defining position and said closed container defining position including a pair of spaced fold lines extending in the central portion of said flat bottom wall between the central portions of the associated pair of side walls and cooperating fold line means in the central portions of said pair of side walls; said thin wall structure when in said closed container defining position being folded along said pair of spaced fold lines and cooperating fold line means to generally enclose a fast food containing space encompassed (1) at its bottom by a portion of said bottom wall defined peripherally by one of said pair of fold lines, an adjacent end edge and the portions of said side edges extending therebetween, (2) at its top by a portion of said bottom wall defined by the other of said pair of fold lines, an adjacent end edge and the portions of said side edges extending therebetween, and (3) peripherally by said end and side walls and a central portion of said bottom wall defined peripherally by said pair of fold lines and the portions of said side edges extending therebetween, the improvement which comprises said fold line means forming outwardly folding flaps when said thin wall structure is moved from said tray defining position to said closed container defining position, and means for releasably retaining said flaps in a contiguous exterior locking position operable to retain said structure in said closed container defining position.

2. A fast food containing the serving device as defined in claim 1 wherein said fold line means in each central side wall comprises two inner fold lines extending from the spaced points of intersection between said pair of fold lines and the associated side edge in angularly converging relation to a central point on the outer edge of the central portion of the associated side wall and two outer fold lines extending from said spaced points in diverging relation with respect to the associated inner fold lines to points on the outer edge of the central portion of the associated side wall spaced in opposite directions from said central point.

3. A fast food containing and serving device as defined in claim 2 wherein said inner fold lines are outboard fold lines and said outer fold lines are inboard fold lines so that when said thin wall structure is folded into said container defining position each flap including the triangular side wall section defined by the associated inner fold lines and the portion of the associated side edge extending therebetween extends outwardly and rearwardly.

4. A fast food containing and serving device as defined in claim 3 wherein said releasable flap retaining means comprises slots in the associated section of the central portion of the bottom wall defining locking tabs for yieldingly retaining each locking flap in cooperating relation therewith when the latter is hinged into said cooperating relation.

5. A fast food containing and serving device as defined in claim 4 wherein the portion of each side edge extending between each pair of inner fold lines includes a biconvex lens-shaped slot opening portion operable during the hingeing of the associated locking flap into said cooperative relation to open the slots defining the associated locking tabs.

6. A fast food containing and serving device as defined in claim 5 wherein the central portion of said bottom wall is provided with a central outboard crease line extending perpendicularly between said pair of parallel fold lines and an inboard crease line on each side of said central outboard crease line in parallel relation therewith, the arrangement providing an over-center toggle action when said flaps are in said cooperating relation with the associated locking tabs.

7. A fast food containing and serving device as defined in claim 6 wherein the locking tabs associated with each flap are of side-by-side triangular configuration of a size to overlie a triangular tip portion of the associated flap.

8. A fast food containing and serving device as defined in claim 1, 2, 3, 4, 5, 6, or 7, wherein said thin wall structure is assembled into said stable three-dimensional nestable tray from a flat blank formed from a sheet of relatively thin paperboard, said flat blank having a periphery providing two edges defining the outer edges of said side walls and two edges defining the outer edges of said end walls and a corner cut-out between each adjacent end and side edge defining a tab portion, said flat blank having four fold lines extending between adjacent corner cut-outs, two of said four fold lines forming said pair of side edges when the adjacent side walls are folded upwardly and outwardly with respect to each other, the other two of said four fold lines forming the pair of end edges when the adjacent end walls are folded upwardly and outwardly with respect to each other, said means for fixedly interconnecting the associated pair of adjacent end and side walls comprising the tab portion associated with the corner cut-out thereof, the tab portion being hinged along a fold line to one of the associated pair of walls and being fixed in surface-to-surface contact with the other of the associated pair of walls.

9. A fast food containing and serving device as defined in claim 1, 2, 3, 4, 5, 6 or 7, wherein when said thin wall structure is in said container defining position the end wall and side wall portions associated with the top defining bottom wall portion extends downwardly therefrom a distance greater than the distance of upward extent of the end wall and side wall portions associated with said bottom defining bottom wall portion.

10. A fast food containing and serving device as defined in claim 9 wherein when said thin wall structure is in said container defining position the juncture between the end wall and each side wall portion associated with the top defining bottom wall portion is recessed so as to receive the juncture between the end wall and each side wall portion associated with the bottom defining bottom wall portion and limit the relative movement therebetween.

11. In a thin wall container of the type movable between opened and closed positions, said container when in a closed position including a bottom structure including a bottom wall having spaced side wall portions upstanding from opposite side edges thereof, a top structure including a top wall having spaced side wall portions depending from opposite side edges thereof and a rear wall extending between rear edges of said bottom and top walls and having foldable portions extending from side edges thereof interconnected with the associated upstanding and depending side wall portions, the improvement which comprises each of said foldable portions being folded outwardly with respect to the associated rear wall side edge and side wall portions into a flap hinged for movement between a locking position generally in engagement with the rearward surface of said rear wall so as to retain said container in said closed position and a releasing position permitting said container to be moved from its closed position into its open position and means for releasably reatining each of said flaps in the locking position thereof.

12. The improvement as defined in claim 11 wherein each flap retaining means comprises slots in said rear wall defining locking tabs for yieldingly retaining the associated flap in said locking position.

13. The improvement as defined in claim 12 wherein the hinge connection of each flap includes a biconvex lens-shaped slot opening portion operable during the hingeing of the associated flap into said locking position to open the slots defining the associated locking tabs.

14. The improvement as defined in claim 13 wherein the central portion of said rear wall is provided with a central outboard crease line extending perpendicularly thereacross and an inboard crease line on each side of said central outboard crease line in parallel relation therewith, the arrangement providing an over-center toggle action when said flaps are retained in said locking position by the associated locking tabs.

15. The improvement as defined in claim 14 wherein the locking tabs associated with each flap are of side-by-side triangular configuration of a size to overlie a triangular tip portion of the associated flap.

16. In a thin wall container of the type movable between opened and closed positions, said container when in a closed position including a bottom structure including a bottom wall having a side wall portion upstanding from a side edge thereof, a top structure including a top wall having a side wall portion depending from an associated side edge thereof and a rear wall extending between rear edges of said bottom and top walls and having a foldable portion extending from an associated side edge thereof interconnected with the associated upstanding and depending side wall portions, the improvement which comprises said foldable portion being folded outwardly with respect to said rear wall side edge and side wall portions into a flap hinged for movement between a locking position retaining said container in said closed position and a releasing position permitting said container to be moved from its closed position into its open position and means for releasably retaining said flap in said locking position.

* * * * *